US011661158B2

(12) United States Patent
Han et al.

(10) Patent No.: US 11,661,158 B2
(45) Date of Patent: May 30, 2023

(54) VESSEL

(71) Applicants: Yun Hye Han, Seoul (KR); John Suk Lee, Aurora, CO (US)

(72) Inventors: Yun Hye Han, Seoul (KR); John Suk Lee, Aurora, CO (US)

( * ) Notice: Subject to any disclaimer, the term of this patent is extended or adjusted under 35 U.S.C. 154(b) by 118 days.

(21) Appl. No.: 17/213,654

(22) Filed: Mar. 26, 2021

(65) Prior Publication Data

US 2022/0169344 A1 Jun. 2, 2022

(30) Foreign Application Priority Data

Nov. 27, 2020 (KR) ..... 10-2020-0162998

(51) Int. Cl.

| | |
|---|---|
| ***B63B 39/00*** | (2006.01) |
| ***B63B 39/03*** | (2006.01) |
| ***B63B 21/64*** | (2006.01) |
| ***B63B 43/06*** | (2006.01) |
| ***B63B 1/04*** | (2006.01) |
| ***B63B 1/32*** | (2006.01) |
| ***B63B 1/38*** | (2006.01) |

(52) U.S. Cl.

CPC ..... *B63B 39/005* (2013.01); *B63B 1/04* (2013.01); *B63B 1/32* (2013.01); *B63B 1/38* (2013.01); *B63B 21/64* (2013.01); *B63B 39/03* (2013.01); *B63B 43/06* (2013.01); *B63B 2207/02* (2013.01)

(58) Field of Classification Search

CPC ..... B63B 39/00; B63B 39/03; B63B 30/005; B63B 21/00; B63B 21/64; B63B 43/00; B63B 43/06; B63B 2207/02; B63B 1/00; B63B 1/04; B63B 1/322; B63B 1/38

USPC ..... 114/293, 264, 265, 266

See application file for complete search history.

(56) References Cited

U.S. PATENT DOCUMENTS

| | | | | |
|---|---|---|---|---|
| 4,224,891 | A * | 9/1980 | Rinaldi | B63B 39/00 114/264 |
| 2005/0115484 | A1 | 6/2005 | Trimaran | |
| 2020/0331563 | A1 * | 10/2020 | Johnston | B63B 39/00 |

FOREIGN PATENT DOCUMENTS

| | | | |
|---|---|---|---|
| JP | 04325391 | A | 11/1992 |
| JP | 2001-311112 | A | 11/2001 |
| KR | 1020100137599 | A | 12/2010 |
| KR | 102011073868 | A | 6/2011 |
| KR | 1020120000970 | A | 1/2012 |

OTHER PUBLICATIONS

The Gurit Magazine, Gurit Holding AG; Aug. 2014, No. 15, pp. 16-19; "First-Class Stride Across The Waves".

(Continued)

*Primary Examiner* — Lars A Olson

(74) *Attorney, Agent, or Firm* — Taft Stettinius & Hollister LLP

(57) ABSTRACT

According to an embodiment of the present disclosure, a vessel includes: a hull 100 provided with a propellant 140; a deck 200 spaced apart from the hull 100; and a support 300 between the hull 100 and the deck 200, the support 300 configured to support 300 the deck 200 with respect to the hull 100, wherein the hull 100 is disposed below a water surface during operation, and the deck 200 is supported by the support 300 to be disposed above the water surface during operation.

12 Claims, 4 Drawing Sheets

(56) References Cited

OTHER PUBLICATIONS

Authors: Yi Zheng, Wencai Dong; "Development of an Unmanned Submersible Small Waterplane Aera Single Hull Ship with Hydrofoil"; 2011 International Conference on Electrical and Control Engineering, IEE, 2011, p. 2161-2165, DOI: 10.1109 / ICECENG. 2011.6057016, ISBN 978-1-4244-8163-7.
Japan Patent Office; JPO Office Action to corresponding Japanese Patent Application No. 2021-057232; dated Apr. 26, 2022.
KR Office Action, Corresponding Korean Patent Application No. KR10-2020-0162998; dated Dec. 6, 2021; pp. 1-6; Non-English.

* cited by examiner

[FIG1]
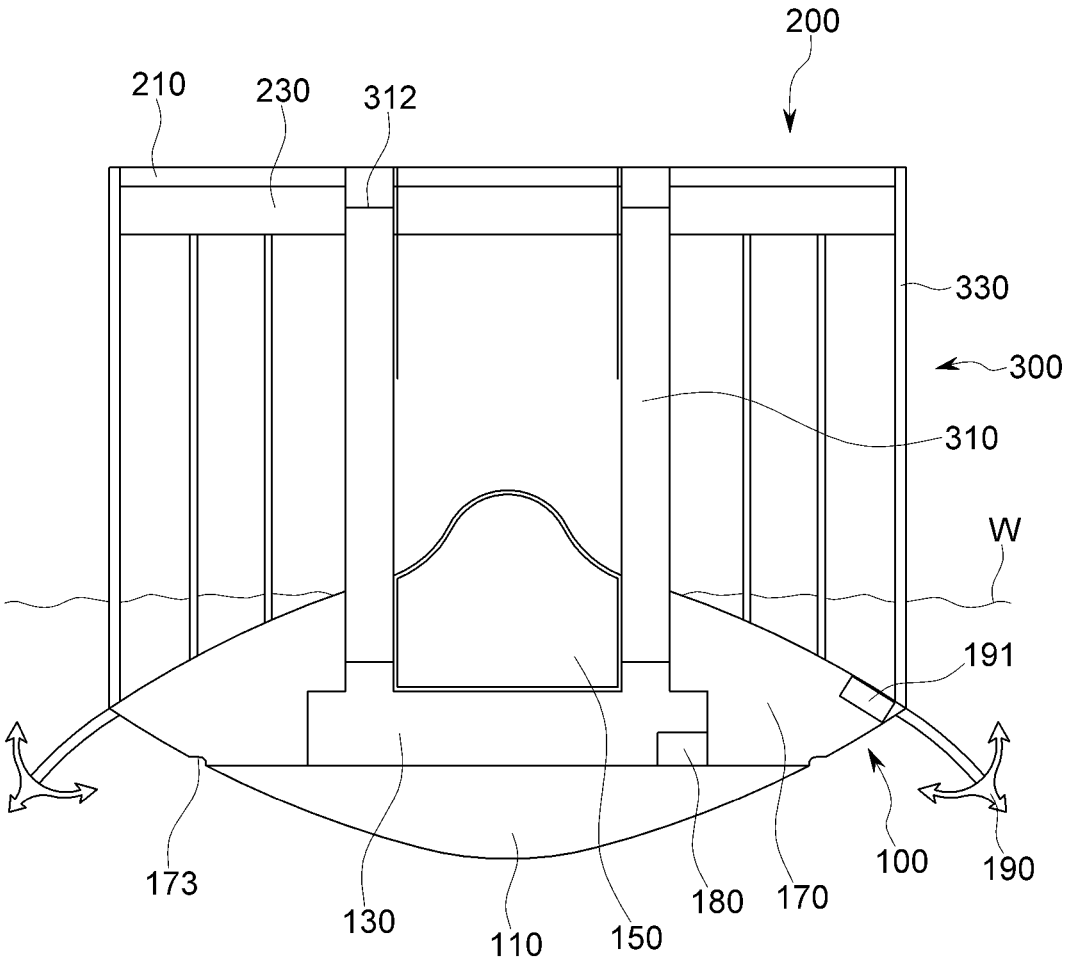

[FIG2]
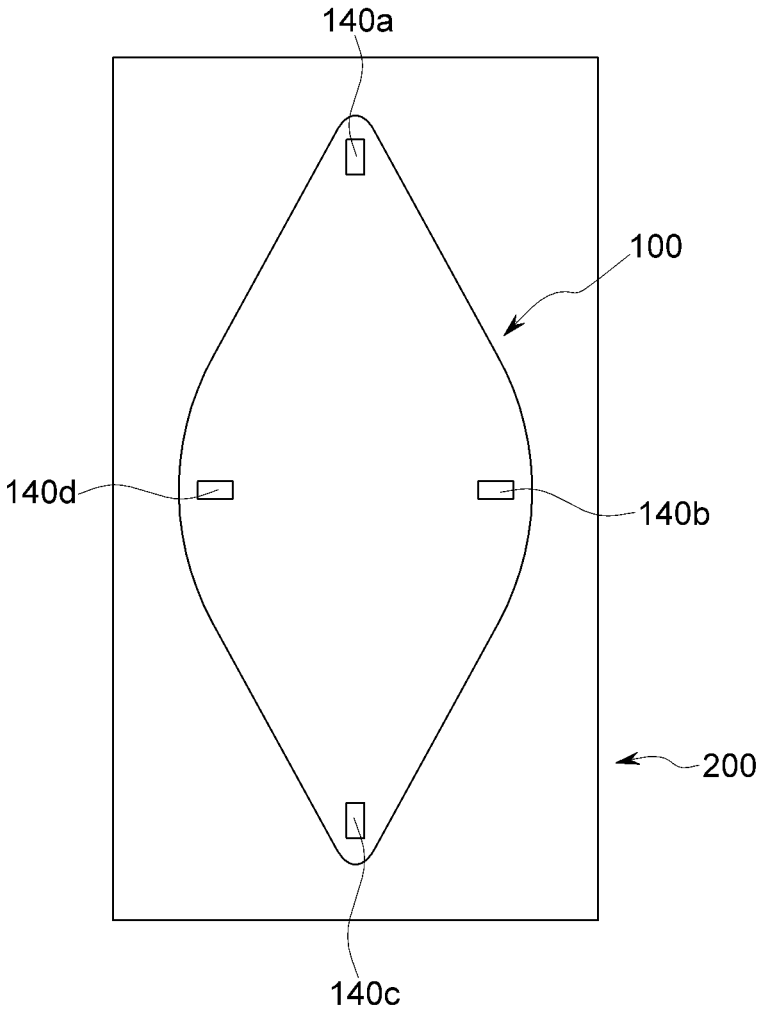

[FIG3]
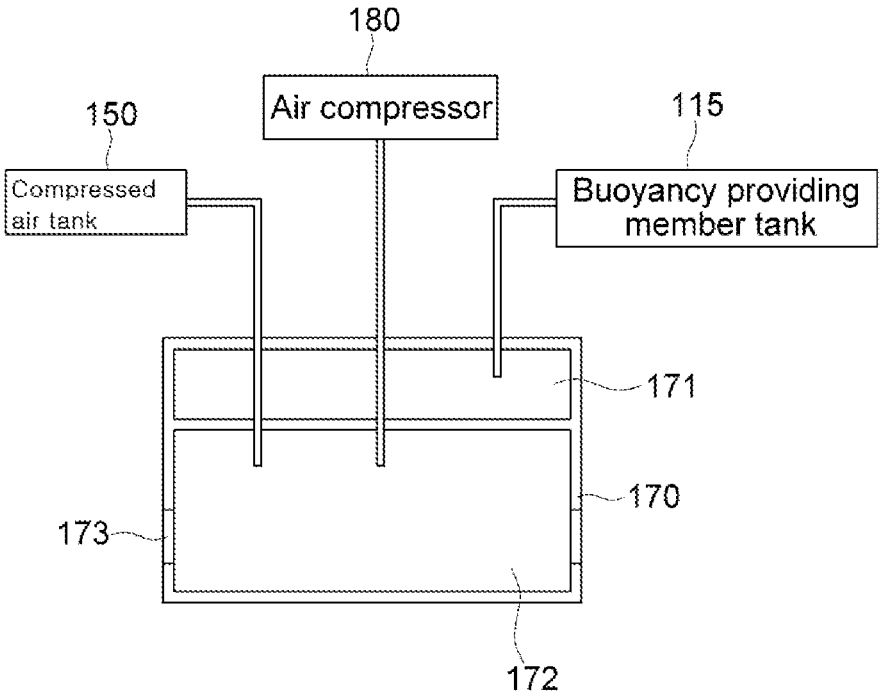

[FIG4]
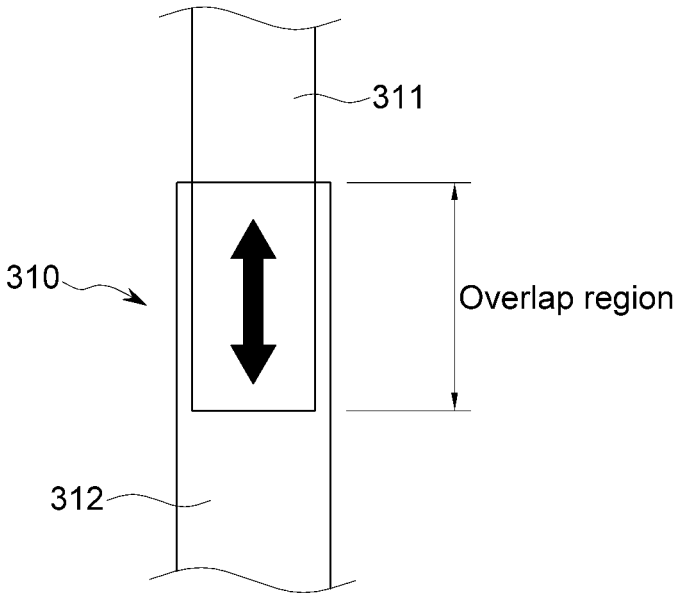

VESSEL

CROSS-REFERENCE TO RELATED APPLICATIONS

This application claims priority to Korean Patent Application No. 10-2020-0162998, filed on Nov. 27, 2020, in the Korean Intellectual Property Office (KIPO), the disclosure of which is incorporated by reference herein in its entirety.

BACKGROUND

1. Field

Embodiments of the present disclosure relate to a vessel, and more particularly, to a vessel capable of maintaining stability by substantially minimizing influence of waves and sea winds on a deck on which people go around.

2. Description of Related Art

In general, a hull on which a propellant is disposed and a deck are integrally formed in a vessel. Accordingly, when it navigates in a sea with waves, the hull and the deck may all be affected by waves and stability thereof may be impaired.

Meanwhile, as the vessel operates in a state that the hull is partially submerged below the water and a part of the hull is exposed above the water, so high hydrodynamic drag is applied to the hull.

In addition, since the hull is exposed above the water surface, there is a problem in that the risk of immediate exposure of major propellants or engines to enemy attacks increases in the case of military vessels.

SUMMARY

Aspects of embodiments of the present disclosure are directed to a vessel capable of substantially minimizing the influence of waves on a deck on which people go around.

According to an embodiment, a vessel includes: a hull 100 provided with a propellant 140; a deck 200 spaced apart from the hull 100; and a support 300 between the hull 100 and the deck 200, the support 300 configured to support 300 the deck 200 with respect to the hull 100, wherein the hull 100 is disposed below a water surface during operation, and the deck 200 is supported by the support 300 to be disposed above the water surface during operation.

In some embodiments, the hull 100 may be formed in an overall disk shape, and a vertical width of a radial center portion of the hull 100 may be larger than that of an edge.

In some embodiments, the hull 100 may include: a compressed air tank 150 at an upper side of a center portion of the hull 100, the compressed air tank 150 filled with a compressed air; a hangar 130 below the compressed air tank 150 and capable of storing shipment; a plurality of ballast tanks 170 around the hangar; and a seawater tank 110 at a lower side of the center portion of the hull 100 and filled with seawater.

In some embodiments, at least a portion of the compressed air tank 150 may be disposed above the water surface.

In some embodiments, the ballast tank may be filled with at least one of a buoyancy providing member, air, and water to provide buoyancy to the deck 200.

In some embodiments, the deck 200 may include a first area 210 and a second area 210 for providing buoyancy to the first area 210.

In some embodiments, a buoyancy providing member may be disposed in the second area 210 to occupy a certain volume.

In some embodiments, the support 300 may include a plurality of struts 330 between the hull 100 and the deck 200; and a shaft 310 for transferring the shipment from the deck 200 to the hangar.

In some embodiments, the propellant 140 may include a plurality of driving devices installed at different positions of the hull 100.

In some embodiments, a traveling direction of the hull 100 may be determined by driving at least one driving device selected from among the plurality of driving devices.

In some embodiments, a first buoyancy may be formed by the ballast tank of the hull 100 and a second buoyancy may be formed by the second area 210 of the deck 200.

In some embodiments, a center of buoyancy of the vessel may be formed higher than a center of gravity of the vessel.

In some embodiments, at least one anchor 190 for anchoring and at least one anchor 190 for towing may be disposed in the hull 100.

According to one or more embodiments of the present disclosure, a hull 100 is submerged below a water surface, and a deck 200 is supported while spaced apart from the hull 100 and disposed above the water surface, thereby substantially minimizing the influence of waves or storms and increasing stability.

In addition, since the hull 100 is formed in an overall disk shape and has an edge in a cusp shape, hydrodynamic drag during operation may be substantially minimized.

In addition, since the deck 200 includes a second area 230 that may provide auxiliary buoyancy, it is possible to provide stable buoyancy to the deck 200 even if the buoyancy decreases due to failure of the hull 100.

BRIEF DESCRIPTION OF THE DRAWINGS

FIG. 1 is a view conceptually illustrating a vessel according to various embodiments of the present disclosure.

FIG. 2 is a bottom view illustrating a hull 100 of the vessel of FIG. 1.

FIG. 3 is a view conceptually illustrating a ballast tank of the hull 100 according to various embodiments of the present disclosure.

FIG. 4 is a view conceptually illustrating a structure in which a height of the shaft 310 is adjusted in an embodiment of the present disclosure.

DETAILED DESCRIPTION

Hereinafter, for convenience of description, some embodiments of the present disclosure will be described through exemplary drawings. In indicating of reference numerals for elements in each drawing, the same elements are denoted by the same numerals as possible even if they are indicated on different drawings.

It is to be understood that the terms or words used in the specification and claims are not limited to their usual or dictionary meanings, and it should be interpreted as a meaning and concept consistent with the technical idea of the present disclosure on the principle that the inventor may appropriately define the concept of terms in order to describe his or her invention in the best way. In addition, terms such as first, second, A, B, (a), and (b) may be used to describe the constituent elements of embodiment of the present disclosure. These terms are only for distinguishing the component from other components, and the nature, order, or sequence of the component are not limited by the term. When a component is described as being 'connected' or 'coupled' to another component, that component may be directly connected or coupled to that other component, but it should be further understood that still another component may be 'connected' or 'coupled' between that component and another component.

Accordingly, embodiments described herein and configurations illustrated in the drawings are only the most preferred embodiments of the present disclosure by way of example, and do not represent all the technical ideas of the present disclosure, and thus it should be understood that there may be various equivalents and variations that may replace them at the time of application. Further, detailed descriptions of known functions and configurations that may unnecessarily obscure the subject matter of the present disclosure will be omitted.

Hereinafter, a vessel (e.g., ship, boat, etc.) according to various embodiments of the present disclosure will be described in detail with reference to the accompanying drawings.

FIG. 1 is a view conceptually illustrating a vessel according to various embodiments of the present disclosure, FIG. 2 is a bottom view illustrating a hull 100 of the vessel of FIG. 1, FIG. 3 is a view conceptually illustrating a ballast tank of the hull 100 according to various embodiments of the present disclosure, and FIG. 4 is a view conceptually illustrating a structure in which a height of the shaft 310 is adjusted in an embodiment of the present disclosure.

A vessel according to various embodiments of the present disclosure described below may not be limited in size and may have features that it may navigate at a high speed, consume less fuel due to low water resistance, and allow semi-permanent anchoring.

First, referring to FIGS. 1 to 3, a vessel according to various embodiments of the present disclosure may include a hull (e.g., ship body, vessel body, etc.) 100, a deck 200, and a support 300. The vessel according to various embodiments of the present disclosure is characterized in that the deck 200 is disposed upwardly of the hull 100 while separated and spaced apart from the hull 100 and is stably supported by the support 300 with respect to the hull 100.

The hull 100 is disposed to be submerged below a water surface, and may move (e.g., navigate, travel, etc.) the vessel with a driving force generated through a propellant (e.g., propulsion body) 140. The hull 100 according to various embodiments of the present disclosure may be provided in an overall horizontally wide disk shape and may include a center portion having a vertical width in a radial direction larger than that of an edge. In addition, as illustrated in FIG. 1, the edge of the hull 100 is formed in a cusp-shape, thereby substantially minimizing hydrodynamic drag applied to the hull 100 during operation. In addition, since the hull 100 according to various embodiments has a sharp edge, it is possible to navigate at high speed and reduce fuel consumption by minimizing water resistance.

The hull 100 may be thin in a vertical direction and wide in a horizontal direction. Typically, a hull 100 and a deck 200 are integrally (e.g., unitarily) formed in a vessel, and accordingly, a size of a part of the hull 100 that is submerged in the water is inevitably large when a size of the vessel is large. In general, as the size of the hull 100 increases, a speed decreases or fuel efficiency is lowered due to high hydrodynamic drag during operation.

However, in the present disclosure, as described above, since the hull 100 is provided in an overall horizontally wide disk shape, and since the edge is formed in a cusp-shape, the hydrodynamic drag applied to the hull 100 during operation may be substantially minimized. Accordingly, there is no limitation on the size of the hull 100 due to hydrodynamic drag and it may be applicable to large vessels such as military aircraft carriers.

The vessel according to various embodiments of the present disclosure may navigate while an entire portion of the hull 100 is submerged below the water surface. This allows the vessel to achieve high speeds without being affected by waves or storms when navigating or anchoring.

In addition, in an embodiment of the present disclosure, since the vessel is operated in a state that an entire portion of the hull 100, except for some portions of a compressed air tank 150 to be described below, is submerged below the water surface, it may achieve high speeds without being affected by waves or storms.

In addition, according to embodiments of the present disclosure, since the vessel may operate while the hull 100 is submerged below the water surface like a submarine, it may not be exposed to enemy attack when used as a military vessel, and damage to vessel's flotation capability due to enemy attack may be substantially minimized and safe operation may be enabled. In addition, since the hull is disposed to be submerged below the water surface, there is an effect that it is easy to change direction during high-speed navigation and/or to operate the vessel on a shallow shore.

In addition, since the hull 100 according to various embodiments is formed in an overall disk shape in which a vertical width of an edge thereof is smaller than a vertical width of a center portion thereof in a radial direction, it may stably move even in a shallow sea.

Since the hull 100 is disposed to be submerged below the water surface, it may be manufactured using a material having high rigidity. In an embodiment, the hull 100 may improve rigidity by using, for example, a sandwich steel plate formed by stacking a wavy steel plate. In such an embodiment, the rigidity may be substantially maximized by arranging the wavy shapes of the stacked steel sheets to have directions perpendicular to each other. However, embodiments of the present disclosure are not limited thereto, and the hull 100 may be formed of light and high rigidity materials such as titanium or composite metal foam (CMF). In addition, or alternatively, a material such as fiber reinforced plastic (FRP) that may maintain high rigidity with respect to weight while having high corrosion resistance may be used.

According to various embodiments of the present disclosure, the hull 100 may be provided with a propellant (e.g., propulsion body) 140 that provides a driving force so as to move underwater. The propellant 140 may include a plurality of driving devices (e.g., 140*a*, 140*b*, 140*c* and 140*d* in FIG. 2). In an embodiment, an internal combustion engine such as a general diesel engine may be used as the driving device (e.g., 140*a* in FIG. 2), but embodiments are not limited thereto, and an electric motor or a hydraulic motor may be used, and it is obvious that any known driving body that may provide a driving force in water may be used.

In addition, a plurality of driving devices 140*a* may be disposed at various positions of the edge of the hull 100. In an embodiment, the driving devices 140*a*, 140*b*, 140*c*, and 140*d* may be disposed on four-directional edges (e.g., east, west, south, north) of the hull 100, respectively. Through the arrangement of the plurality of driving devices 140*a*, 140*b*, 140*c*, and 140*d*, it is possible to move in a desired direction by operating a propellant corresponding to the direction desired to be moved without a rudder. In addition, the vessel according to various embodiments of the present disclosure may be able to move backward through the arrangement of the driving device 140*a*. In addition, or alternatively, the moving direction may be controlled by operating at least two or more driving devices 140*a* at the same time. However, embodiments are not limited thereto, and a plurality of driving devices 140*a* may be additionally disposed between the driving devices 140*a* disposed at the edges of the four directions, and through this arrangement, the moving direction of the vessel and the driving devices 140*a* may be further subdivided and operated accordingly.

However, it is also possible that one driving device 140*a* may be disposed in the hull 100 as in the conventional art, and a rudder (not illustrated) for controlling the moving direction of the vessel may be provided. In addition, the hull 100 may be provided with a horizontal rudder (not illustrated) for controlling a vertical position of the vessel.

In addition, at least one anchor 190 may be disposed at the hull 100 according to various embodiments. In an embodiment, the anchor 190 may be used for anchoring the vessel. In addition, or alternatively, the anchor 190 may be used for towing the vessel. In an embodiment, a plurality of anchors 190 may be disposed along a circumference of the hull 100. In an embodiment, the plurality of anchors 190 may be disposed at positions corresponding to each other along the circumference of the hull 100. For example, the anchors 190 may be installed at intervals of 90 degrees along the circumference of the hull 100, thereby securing the hull 100 in four directions.

In an embodiment, when the anchor 190 is used for anchoring, the anchor 190 may be secured at a position far away from the hull 100 in the horizontal direction, rather than being lowered in a perpendicular direction from the hull 100, so that the vessel of the present disclosure may serve as an island.

To this end, in an embodiment, a method may be used whereby a separate anchor installation vessel may pull the anchor 190 away from the hull 100 and put it down. In an embodiment, the anchor 190 may be disposed at a position a predetermined distance away from the hull 100 in the horizontal direction, at an angle of approximately 45 degrees downward with respect to the hull 100, so that the vessel may be stably secured by a cable connecting the anchor 190 and the hull 100.

In another embodiment, an anchor projectile (not illustrated) for projecting (e.g., launching) the anchor 190 away from the hull 100 in a horizontal or vertical direction may be provided. In the present disclosure, by releasing the anchor 190 from the hull 100 through the anchor projectile, the anchor 190 may move away from the vessel without a separate installation vessel.

According to various embodiments of the present disclosure, a compressed air tank 150, a hangar (e.g., storage) 130, a ballast tank 170, and a seawater tank 110 may be provided in the interior of the hull 100.

The compressed air tank 150 may serve to compensate for buoyancy of the vessel. To this end, a compressed air may be filled in the compressed air tank 150. Additional or auxiliary buoyancy may be formed by the compressed air tank 150 filled with the compressed air therein. When a slight fluctuation occurs in the total weight of the vessel, the compressed air tank 150 and/or a strut 330, to be described below, may compensate for the buoyancy of the vessel to form the overall buoyancy in a stable state. That is, the buoyancy of the vessel may be adjusted by the compressed air accommodated in the compressed air tank 150.

In the present disclosure, if a fluctuation range of the total weight of the vessel exceeds the limit of the buoyancy that may be compensated by the compressed air tank 150 and the strut 330, the total buoyancy may be stably controlled by the ballast tank 170. That is, in the present disclosure, the buoyancy for the hull 100 may be provided complementarily through the ballast tank 170, the compressed air tank 150, and the strut 330.

The compressed air tank 150 may be mostly disposed at an upper side or upper portion of a radial center portion of the hull 100. In an embodiment, the compressed air tank 150 may be formed so that at least some portions thereof may protrude upward from the hull 100. In an embodiment, the compressed air tank 150 may be disposed to be submerged below the water surface during navigation of the vessel. According to another embodiment, at least a part of an upper portion of the compressed air tank 150 may be disposed to be exposed above the water surface. Accordingly, the hull 100 of the present disclosure may move in a state that an entire portion of the compressed air tank 150, except for at least some portions, is disposed below the water surface.

The hangar 130 may form a space in which shipment may be shipped inside the hull 100. In an embodiment, in the interior space of the hangar 130, a power plant, a warehouse, and/or an accommodation may be provided in addition to the shipment, and the driving devices 140*a*, 140*b*, 140*c*, and 140*d* of the propellant 140 may be installed as well. For example, when the vessel is used for military purposes, military items such as aircraft or weapons may be loaded inside the hangar 130. The hangar 130 may be formed below the compressed air tank 150. The hangar 130 communicates with the deck 200 through a shaft 310 so that the shipment may be transferred from the deck 200 to the hangar 130 through the shaft 310.

An air compressor 180 may inject air into the ballast tank 170. The air compressor may inject air into the ballast tank 170 to discharge water. The air compressor 180 may compress air inside the hangar 130 and supply it to the ballast tank 170.

The ballast tank 170 may provide a primary first buoyancy for the vessel. The ballast tank 170 may serve to control the buoyancy of the vessel. The ballast tank 170 may be disposed mostly in an upper area of the hull 100.

In an embodiment, the ballast tank 170 may form a single accommodation space. In an embodiment, the ballast tank 170 may be partitioned into a plurality of accommodation spaces around the hangar 130. Each accommodation space of the ballast tank 170 may be sealed from each other. In an embodiment, each of the accommodation spaces may introduce/discharge seawater through each seawater inlet port 173.

In an embodiment, at least a portion of the interior of the accommodation space of the ballast tank 170 may be sealed in a state of being filled with air and a buoyancy providing member such as polystyrene. In addition, at least a portion of the ballast tank 170 may be filled with water so as to cope with an overall weight fluctuation of the vessel. In the ballast tank 170, water may be introduced or discharged through the seawater inlet port 173 formed in the hull 100, so that an amount of water filled therein may be adjusted. The buoyancy providing member according to the present disclosure is to prevent sinking of all or part of the vessel by providing buoyancy when unplanned seawater penetrates into the inside of the ballast tank 170 due to damage on all or part of the vessel. In an embodiment, the buoyancy providing member may be provided in the form of particles having a certain volume. In addition, the buoyancy providing member may be formed of polystyrene or expandable polystyrene material, but embodiments are not limited thereto, and the buoyancy providing member may be formed of a material capable of floating in water or seawater.

As the amount of water filled in the ballast tank 170 is adjusted, the buoyancy of the vessel may be adjusted. In order to discharge the water filled in the ballast tank 170, the air inside the hangar 130 may be compressed through the air compressor 180 and injected into the ballast tank 170. In an embodiment, when air may not be supplied to the ballast tank 170 through the air compressor 180, compressed air may be provided through the compressed air tank 150.

The amount of water filled in the ballast tank 170 may be adjusted, thereby forming a buoyancy enough to submerge the entire hull 100, or the entire hull 100 except for the compressed air tank 150, below the water surface. In addition, the ballast tank 170 may stably control the total buoyancy of the vessel when the weight fluctuation range of the vessel exceeds the limit of the buoyancy that may be compensated by the compressed air tank 150 and the strut 330.

In an embodiment, the ballast tank 170 may be provided with an area in the accommodation space in which seawater, the buoyancy providing member and/or air are accommodated. In an embodiment, the seawater inlet port 173 may be provided with a filter member (not illustrated) for preventing outflow of the buoyancy providing member while seawater is introduced to/discharged from the ballast tank 170.

In another embodiment, as illustrated in FIG. 3, the ballast tank 170 may include a first area 171 into which the buoyancy providing member is injected and a second area 172 into which seawater and/or air is injected. In an embodiment, a buoyancy providing member tank 115 for supplying the buoyancy providing member to the above-described first area 171 may be provided separately.

A seawater tank 110 may be disposed at a lower side of a center portion of the hull 100. A ballast water may be filled inside the seawater tank 110. The seawater tank 110 may serve to maintain balance of the vessel by filling the ballast water therein.

As described above, according to the present disclosure, since the ballast tank 170 and the compressed air tank 150 which provide buoyancy to the vessel are located at an upper side or upper portion of the hull 100, a center of buoyancy of the vessel may be formed higher than a center of gravity of the vessel. That is, according to the present disclosure, since the center of gravity of the vessel is formed lower than the center of buoyancy, when the vessel is tilted (inclined), the vessel may maintain stability by a lifting force of the center of buoyancy.

The deck 200 according to various embodiments of the present disclosure may be disposed above the water surface while being supported at the hull 100 by the support 300. In the present disclosure, the deck 200 is disposed above the water surface while being separated from the hull 100 which is submerged below the water, so that the influence of waves or storms during operation may be substantially minimized. The deck 200 may be manufactured in various sizes without limitation since the influence of waves or storms may be substantially minimized during operation. In an embodiment, the deck 200 may be provided having substantially the same cross-sectional area as that of the hull 100, but embodiments are not limited thereto. In an embodiment, as illustrated in FIG. 2, the cross-sectional area of the deck 200 may be larger than the cross-sectional area of the hull 100.

Referring to FIG. 1, the deck 200 may include an upper deck (hereinafter, a first area 210) on which crew members go around, various structures are arranged, or shipments are primarily loaded, and a lower deck (hereinafter, a second area 230), below (or under) the upper deck, provided separately from the upper deck to provide auxiliary buoyancy for the first area 210.

At least one buoyancy providing member may be disposed in the second area 230. In the second area 230, the buoyancy providing member may be disposed to occupy a certain volume. For example, the buoyancy providing member may include polystyrene, but embodiments are not limited thereto. The second area 230 may be sealed while the buoyancy providing member is filled therein. In an embodiment, the second area 230 may be filled with a small amount of air together with the buoyancy providing member.

The second area 230 may provide auxiliary buoyance to the first area 210 of the deck 200 when all or part of the ability to provide buoyancy by the hull 100 is lost due to a failure of or impact to the hull 100. That is, if the ballast tank 170 or the compressed air tank 150 of the hull 100 which provides main buoyancy to the vessel fails to perform its normal function due to failure or impact, the vessel may sink deeper than the normal depth, and in such a case, the deck 200 having disposed above the water surface may descend to a water surface level. In such a case, according to embodiments of the present disclosure, the second area 230 disposed below the first area 210 may provide an auxiliary second buoyancy to prevent complete sinking of the first area 210 where the crew members or various facilities are disposed.

Referring back to FIG. 1, according to various embodiments of the present disclosure, the support 300 may support the deck 200, which is formed separately from the hull 100, so that the deck 200 may be spaced apart from the hull 100 at regular intervals. The support 300 may extend to a predetermined length between the hull 100 and the deck 200 perpendicularly thereto.

The support 300 may include a strut (e.g., column, pillar, etc.) 330 and a shaft (e.g., elevator, lift, etc.) 310. The strut 330 and the shaft 310 are preferably formed in a shape capable of substantially minimizing hydrodynamic drag because at least some portions thereof are directly affected by waves. In an embodiment, the strut 330 and the shaft 310 may be provided in a pillar shape in which an inner hollow is formed.

In an embodiment, each of the strut 330 and the shaft 310 may be provided so as to be able to adjust a spacing between the hull 100 and the deck 200. In addition, the strut 330 and the shaft 310 may be provided in a sealing structure to prevent inflow of seawater into the interior of the hull 100 when damaged.

In an embodiment, the strut 330 may provide auxiliary buoyancy for the vessel by filling therein with the buoyancy providing member such as polystyrene and/or air. The strut 330 may be sealed while the inside is filled with the buoyancy providing member and/or air. A plurality of struts 330 may be provided at positions capable of stably supporting the deck 200.

The shaft 310 may be formed to communicate with the first area 210 of the deck 200 and the hangar 130 of the hull 100. The shaft 310 may include an actuator known in the art that may be elevated or lowered in a state in which shipment is loaded. Air may be introduced into the hangar 130 through the shaft 310. In addition, electric wires may be provided through the shaft 310 to provide electricity to the hull 100, and the crew member on the deck 200 may control facilities of the hull 100. Doors 312 which may be open and closed may be installed at upper and lower portions of the shaft 310. When all of the doors 312 are closed, due to the air inside, the shaft 310 may adjust a buoyance force in response to a change in the weight of the vessel together with the compressed air tank 150.

In an embodiment, the shaft 310 and the strut 330 may have their respective vertical lengths variably controlled so as to minimize shaking of the deck 200. Referring to FIG. 4, in an embodiment, the shaft 310 may include an upper portion 311 and a lower portion 312 having diameters different from each other. In such an embodiment, at least some portions of the upper portion 311 and the lower portion 312 may be disposed to overlap each other. In an embodiment, a height of an overlap region may be adjusted by moving the upper portion 311 or the lower portion 312 relatively in the vertical direction. In an embodiment, the shaft 310 is provided with a plurality of portions having at least two or more different diameters, and the portions adjacent to each other may be disposed to overlap each other. In such an embodiment, as the height of the overlap region is adjusted, an overall height of the shaft 310 may be adjusted.

In addition, an entire height of the strut 330 may also be adjusted through the same structure as the shaft 310 described above.

In an embodiment, the deck 200 may be provided with a sensor member (not illustrated) for maintaining the balance. A degree of tilting (inclination) of the deck 200 may be detected through the sensor member. The sensor member may include a gyro sensor, an acceleration sensor, a height sensor, a load sensor, and the like, but embodiments are not limited thereto. According to embodiments of the present disclosure, based on the detection result of the sensor member, it is possible to control the height of the above-described overlap region of each of the shaft 310 and/or the strut 330 so that the balance of the deck 200 may be maintained.

In an embodiment, the length of the shaft 310 and the strut 330 may be controlled by a hydraulic control method using a hydraulic cylinder, but embodiments are not limited thereto, and various known length adjustment means may be used.

As described above, in the vessel according to various embodiments of the present disclosure, the hull 100 may be submerged below the water surface, and the deck 200 may be supported while spaced apart from the hull 100 and disposed above the water surface, thereby substantially minimizing the influence of waves or storms and increasing stability. In addition, since the hull 100 is formed in an overall disk shape and has an edge in a cusp shape, hydrodynamic drag during operation may be substantially minimized. In addition, since the deck 200 includes a second area that may provide auxiliary buoyancy, it is possible to provide stable buoyancy to the deck 200 even if the buoyancy decreases due to abnormality of the hull 100.

Since the vessel according to various embodiments of the present disclosure described above may allow semi-permanent anchoring, like an island, it may anchor on the shore and serve as facilities such as a power plant, a liquid natural gas transport vessel, an oil refinery, a seawater desalination facility, a marine military base, and the like. For example, the vessel according to various embodiments of the present disclosure may be manufactured as facilities such as seawater desalination facilities, and then may be transported by sea to the customer. In an embodiment, when the vessel according to the present disclosure is used as a liquid natural gas transport vessel, when the liquid gas is stored in the hangar 130 provided in the hull 100 which is arranged to be submerged in seawater, it may be possible to save energy consumed to keep the gas liquid because the underwater temperature is lower than the temperature above the water.

In the above, even though all the components constituting embodiments of the present disclosure are described as being coupled into a unit or operating in combination, the present disclosure is not necessarily limited to these embodiments. That is, within the scope of the objectives of the present disclosure, all of the constituent elements may be selectively combined and operated in one or more units. In addition, the terms 'include', 'provided with', or 'have' described hereinabove mean that the corresponding component may be present unless otherwise stated, so it should be understood that other components are not excluded, and other components may be further included. All terms, including technical or scientific terms, have the same meaning as commonly understood by a person of ordinary skill in the art, unless otherwise defined. Terms generally used, such as terms defined in the dictionary, should be interpreted as being consistent with the meaning of the context of the related technology, and are not to be interpreted in an ideal or excessively formal meaning unless explicitly defined in the present disclosure.

The above description is merely illustrative of the technical idea of the present disclosure, and those of ordinary skill in the art to which the present disclosure pertains will be able to make various modifications and variations without departing from the essential characteristics of the present disclosure. Accordingly, embodiments disclosed in the present disclosure are not intended to limit the technical idea of the present disclosure, but to explain the technical idea, and the scope of the technical idea of the present disclosure is not limited by these embodiments. The scope of protection of the present inventive concept should be interpreted by the following claims, and all technical ideas within the scope equivalent thereto should be construed as being included in the scope of the present disclosure.

REFERENCE SIGNS

100: hull
110: seawater tank
130: hangar
150: compressed air tank
170: ballast tank
173: seawater inlet port
190: anchor
200: deck
210: first area
230: second area
300: support
310: shaft
330: strut

The invention claimed is:

1. A vessel comprising:

a hull provided with a propellant;

a deck spaced apart from the hull; and a support between the hull and the deck, the support configured to support the deck with respect to the hull, wherein the hull is disposed below a water surface during operation, and the deck is supported by the support to be disposed above the water surface during operation, and wherein the hull comprises:

a compressed air tank at an upper side of a center portion of the hull, the compressed air tank filled with a compressed air;

a hangar below the compressed air tank and capable of storing shipment;

a plurality of ballast tanks around the hangar; and a seawater tank at a lower side of the center portion of the hull and filled with seawater.

2. The vessel of claim 1, wherein the hull is formed in an overall disk shape, and a vertical width of a radial center portion of the hull is larger than that of an edge.

3. The vessel of claim 1, wherein at least a portion of the compressed air tank is disposed above the water surface.

4. The vessel of claim 1, wherein the ballast tank is filled with at least one of a buoyancy providing member, air, and water to provide buoyancy to the deck.

5. The vessel of claim 1, wherein the deck comprises a first area and a second area for providing buoyancy to the first area.

6. The vessel of claim 5, wherein a buoyancy providing member is disposed in the second area to occupy a certain volume.

7. The vessel of claim 1, wherein the support comprises:

a plurality of struts between the hull and the deck; and a shaft for transferring the shipment from the deck to the hangar.

8. The vessel of claim 1, wherein the propellant comprises a plurality of driving devices installed at different positions of the hull.

9. The vessel of claim 8, wherein a traveling direction of the hull is determined by driving at least one driving device selected from among the plurality of driving devices.

10. The vessel of claim 5, wherein a first buoyancy is formed by the ballast tank of the hull and a second buoyancy is formed by the second area of the deck.

11. The vessel of claim 10, wherein a center of buoyancy of the vessel is formed higher than a center of gravity of the vessel.

12. The vessel of claim 1, wherein at least one anchor for anchoring and at least one anchor for towing are disposed in the hull.

* * * * *